US011667423B2

(12) United States Patent
Yu

(10) Patent No.: US 11,667,423 B2
(45) Date of Patent: Jun. 6, 2023

(54) STRETCH FILM DISPENSER

(71) Applicant: Yang Bey Industrial Co., Ltd., Taichung (TW)

(72) Inventor: Teng-Chi Yu, Taichung (TW)

(73) Assignee: Yang Bey Industrial Co., Ltd., Taichung (TW)

( * ) Notice: Subject to any disclaimer, the term of this patent is extended or adjusted under 35 U.S.C. 154(b) by 5 days.

(21) Appl. No.: 17/515,545

(22) Filed: Oct. 31, 2021

(65) Prior Publication Data

US 2023/0113970 A1 Apr. 13, 2023

(30) Foreign Application Priority Data

Oct. 7, 2021 (TW) ..... 110137370

(51) Int. Cl.
*B65B 67/08* (2006.01)

(52) U.S. Cl.
CPC ..... *B65B 67/085* (2013.01)

(58) Field of Classification Search
CPC ..... B65B 67/085
See application file for complete search history.

(56) References Cited

U.S. PATENT DOCUMENTS

| | | | | |
|---|---|---|---|---|
| 6,920,742 | B1 * | 7/2005 | Yu Chen | B65B 67/085 156/577 |
| 10,479,631 | B1 * | 11/2019 | Yu Chen | B65B 67/085 |
| 10,479,635 | B1 * | 11/2019 | Yu Chen | B65H 16/005 |
| 10,994,884 | B2 * | 5/2021 | Voo | B65H 16/005 |
| 2003/0208994 | A1 * | 11/2003 | Gooding | B65B 67/085 53/390 |
| 2011/0233321 | A1 * | 9/2011 | Yu Chen | B65B 67/085 242/588.2 |
| 2015/0353215 | A1 * | 12/2015 | Yu Chen | B65B 67/085 53/203 |
| 2018/0201400 | A1 * | 7/2018 | Yu Chen | B65B 59/003 |
| 2020/0039675 | A1 * | 2/2020 | Wolf | B65H 16/005 |
| 2020/0346810 | A1 * | 11/2020 | Voo | B65B 67/085 |
| 2021/0171232 | A1 * | 6/2021 | Kraaijestein | B65H 16/106 |
| 2021/0261379 | A1 * | 8/2021 | Yu | B65H 16/005 |

* cited by examiner

*Primary Examiner* — William A. Rivera
(74) *Attorney, Agent, or Firm* — Bruce Stone LLP; Joseph A. Bruce

(57) ABSTRACT

A stretch film dispenser includes a frame. The frame has a top seat and a bottom seat. The top seat and the bottom seat are jointly equipped with a film mounting unit and a film dispensing unit. The film dispensing unit includes a first roller and a second roller. The first roller and the second roller have a strip hole. The strip hole is located between the first roller and the second roller. Through the strip hole of the first roller and the second roller, the front end of a film can pass through the strip hole between the first roller and the second roller easily and quickly, and the film is pulled out along the direction of the first roller, thereby achieving the effect of easy and convenient installation of the film.

9 Claims, 6 Drawing Sheets

STRETCH FILM DISPENSER

FIELD OF THE INVENTION

The present invention relates to a stretch film dispenser, and more particularly to a stretch film dispenser that is convenient for dispensing a film.

BACKGROUND OF THE INVENTION

In order to prevent damages to articles caused by shaking or falling during storage or transport, a stretch film dispenser is used for packing the articles. A conventional stretch film dispenser comprises a rod. One end of the rod is provided with a film mounting unit and a film dispensing unit. The film mounting unit is provided with a film roll. The film dispensing unit has a first roller and a second roller. When the user wants to pack an article, the film of the film roll is first pulled out to pass through the space between the first roller and the second roller, and then the film is pulled to the side of the first roller away from the second roller. After that, one end of the film is attached to the surface of the article. The user holds the rod to pull the stretch film dispenser for performing the packing operation.

However, in the process of pulling out the film of the film roll, since the space between the first roller and the second roller is small, it is not easy for the film to be inserted in the space and pulled out from the space. Accordingly, the inventor of the present invention has devoted himself based on his many years of practical experiences to solve these problems.

SUMMARY OF THE INVENTION

The present invention is to provide a stretch film dispenser for a film roll to be installed with ease.

In order to achieve the aforesaid object, the present invention provides a stretch film dispenser. The stretch film dispenser comprises a frame. The frame has a top seat and a bottom seat. The top seat and the bottom seat are jointly equipped with a film mounting unit and a film dispensing unit. The film dispensing unit includes a first roller and a second roller. The first roller and the second roller have a strip hole. The strip hole is located between the first roller and the second roller.

In the stretch film dispenser provided by the present invention, through the strip hole of the first roller and the second roller, the front end of the film can pass through the strip hole between the first roller and the second roller easily and quickly, and the film is pulled out along the direction of the first roller, thereby achieving the effect of easy and convenient installation of the film.

DETAILED DESCRIPTION OF THE PREFERRED EMBODIMENTS

Embodiments of the present invention will now be described, by way of example only, with reference to the accompanying drawings.

Figure 1:
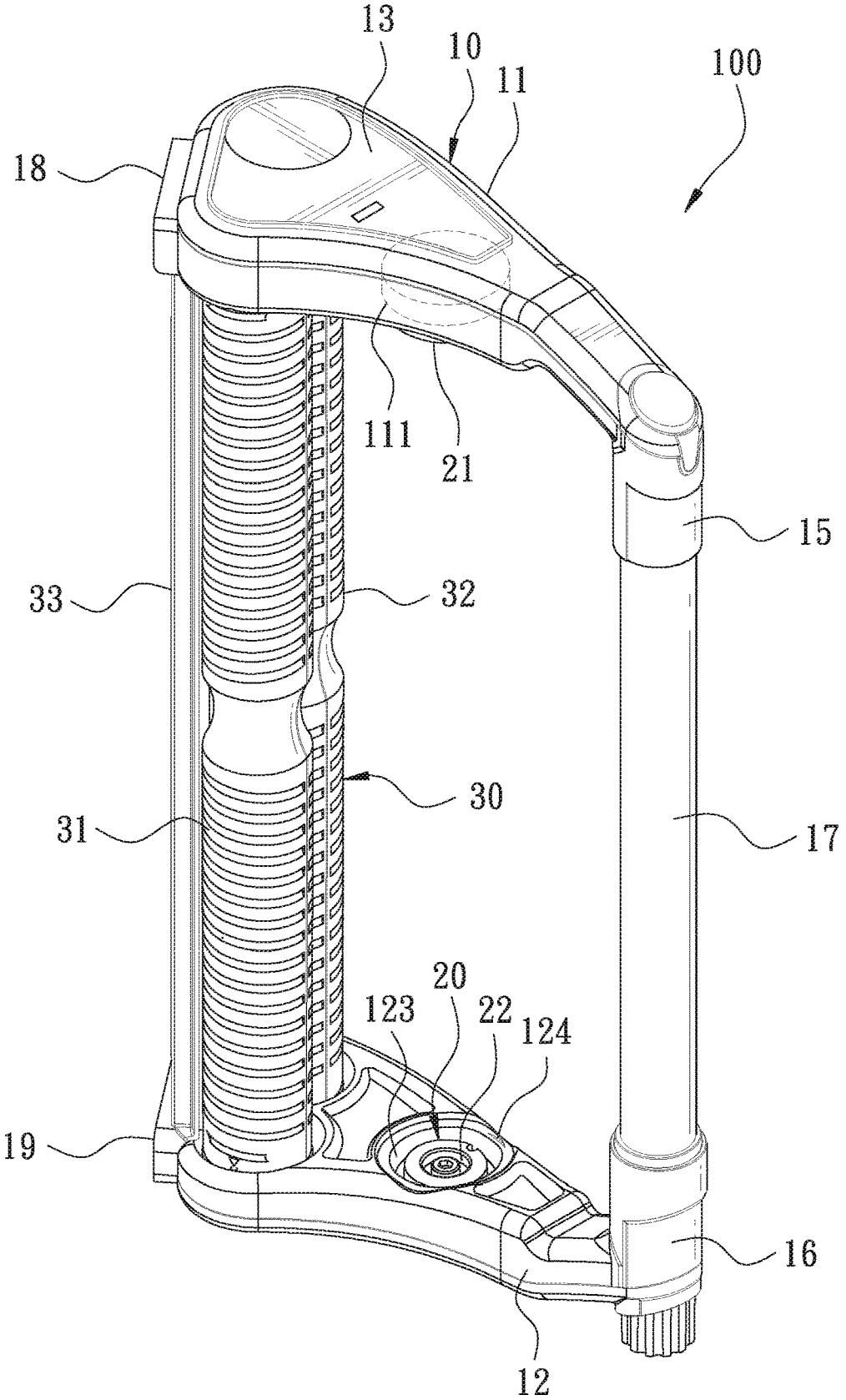
FIG. 1 is a perspective view according to a preferred embodiment of the present invention.
Figure 2:
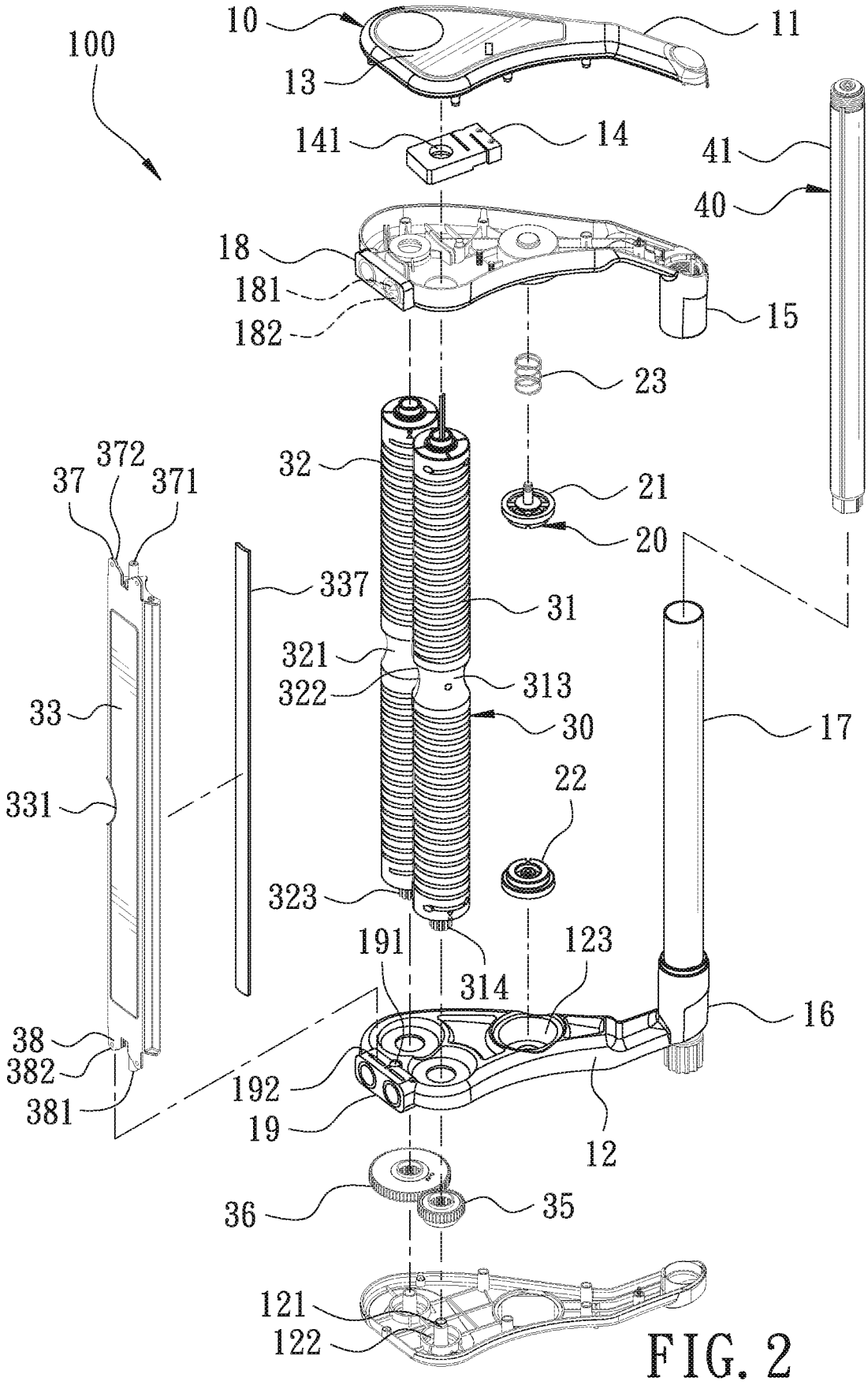
FIG. 2 is an exploded view according to the preferred embodiment of the present invention.
Figure 3:
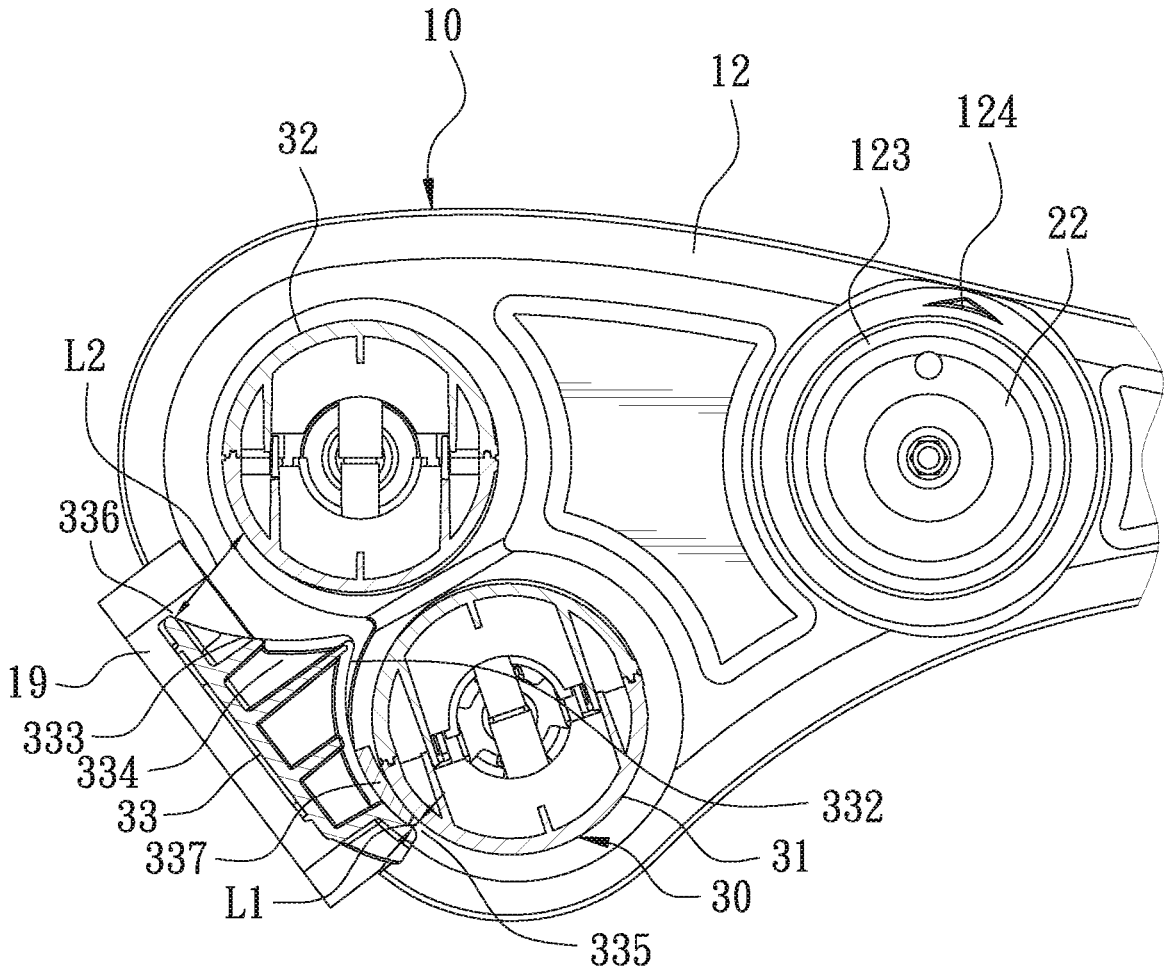
FIG. 3 is a partial sectional view according to the preferred embodiment of the present invention.

FIG. 1 is a perspective view according to a preferred embodiment of the present invention. FIG. 2 is an exploded view according to the preferred embodiment of the present invention. FIG. 3 is a partial sectional view according to the preferred embodiment of the present invention. The present invention discloses a stretch film dispenser 100, comprising a frame 10, a film mounting unit 20, a film dispensing unit 30, and a power unit 40.

The frame 10 has a top seat 11 and a bottom seat 12. The top of the top seat 11 is provided with a control unit 13. In the embodiment of the present invention, the control unit 13 is provided with a control panel. A sensor 14 is provided in the top seat 11. The sensor 14 has a through hole 141. The sensor 14 is electrically connected to the control unit 13. The bottom of the top seat 11 is formed with a first accommodating hole 111. The bottom seat 12 is provided with a retaining member 121. The retaining member 121 is a retaining post. The retaining member 121 has a retaining groove 122. The retaining groove 122 has a non-circular cross-section. The cross-section of the retaining groove 122 may be elliptical or polygonal. The bottom seat 12 is formed with a second accommodating hole 123 corresponding to the first accommodating hole 111. A guide groove 124 is provided on the outer periphery of the second accommodating hole 123. The top seat 11 and the bottom seat 12 are jointly equipped with the film mounting unit 20 and the film dispensing unit 30. One side of the top seat 11 is provided with a first coupling portion 15. One side of the bottom seat 12 is provided with a second coupling portion 16. A hollow tube 17 is connected between the first coupling portion 15 and the second coupling portion 16. The tube 17 is adapted for the user to hold thereon. In addition, the other side of the top seat 11 is provided with a first retaining portion 18 opposite to the first coupling portion 15, and the other side of the bottom seat 12 is provided with a second retaining portion 19 opposite to the second coupling portion 16. The first retaining portion 18 has a receiving hole 181 and a plurality of slots 182. The second retaining portion 19 has a receiving hole 191 and a plurality of slots 192.

The film mounting unit 20 is configured to mount a film roll 200. The film mounting unit 20 includes a first positioning member 21 and a second positioning member 22. The first positioning member 21 and the second positioning member 22 each have a disc shape. The first positioning member 21 is disposed in the first accommodating hole 111 of the top seat 11. The first positioning member 21 is connected to an elastic member 23. Both ends of the elastic member 23 are pressed against the first accommodating hole 111 and the first positioning member 21, respectively. The second positioning member 22 is disposed in the second accommodating hole 123 of the bottom seat 12.

Figure 4:
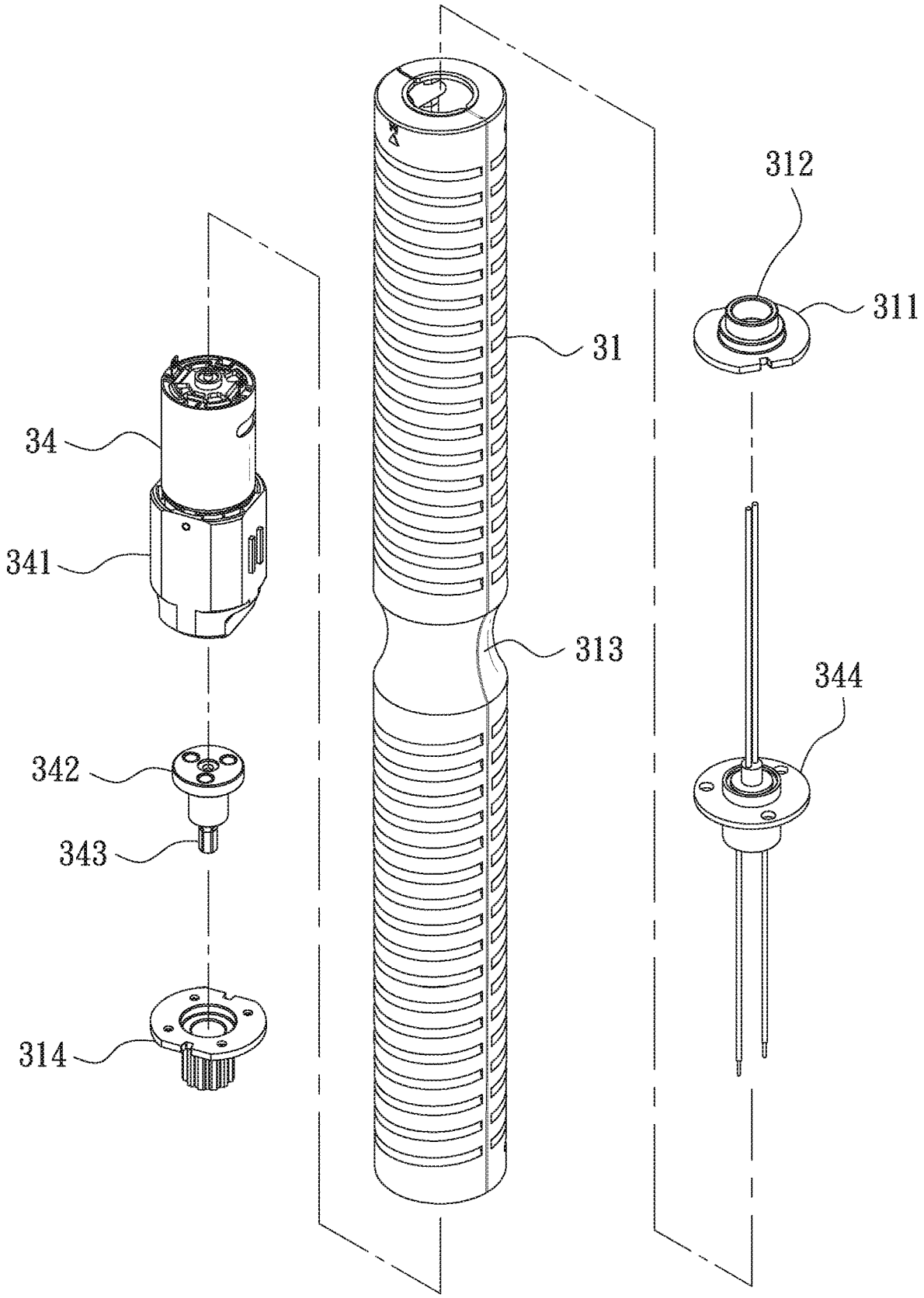
FIG. 4 is an exploded view of the first roller according to the preferred embodiment of the present invention.

The film dispensing unit 30 includes a first roller 31, a second roller 32, and a protective plate 33. FIG. 4 is an exploded view of the first roller according to the preferred embodiment of the present invention. An extension member 311 is connected to one end of the first roller 31. The extension member 311 is pivotally connected to the sensor 14 of the top seat 11. The extension member 311 is provided with an extension ring 312. The extension ring 312 is accommodated in the through hole 141 of the sensor 14. The first roller 31 has a first recessed portion 313 at the middle position along its long axis direction. The diameter of the first recessed portion 313 of the first roller 31 is gradually reduced inward. The first recessed portion 313 is an arc-shaped ring groove. In addition, the other end of the first roller 31, opposite to the extension member 311, is connected to a power drive unit 34. In the embodiment of the present invention, the power drive unit 34 is a motor. The power drive unit 34 is connected to a gear box 341. The gear box 341 is connected to a limiting member 342. One end of the limiting member 342 is provided with a limiting block 343. The limiting block 343 has a non-circular cross-section, corresponding in shape to the cross-section of the retaining member 121. The limiting member 342 is limited to the retaining member 121. The power drive unit 34 is electrically connected to a conductive portion 344. In the embodiment of the present invention, the conductive portion 344 is a conductive slip ring. The conductive portion 344 is electrically connected to the power unit 40, so that the power drive unit 34 can drive the first roller 31 to rotate. One end of the first roller 31, close to the power drive unit 34, is provided with a first linking member 314. The first linking member 314 is connected with the power drive unit 34, the gear box 341 and the first roller 31, so that the power drive unit 34, the first gear box 341, the first linking member 314 and the first roller 31 can rotate synchronously. The first lining member 314 is connected to a first gear 35. One end of the second roller 32 is pivotally connected to the top seat 11. The second roller 32 has a second recessed portion 321 corresponding to the first recessed portion 313 of the first roller 31. The second recessed portion 321 is located at the middle position of the second roller 32. The second recessed portion 321 is an arc-shaped ring groove. The first recessed portion 313 and the second recessed portion 321 jointly form a strip hole 322. The other end of the second roller 32 is provided with a second linking member 323 corresponding to the first linking member 314 of the first roller 31. The second linking member 323 is connected to a second gear 36. The first gear 35 meshes with the second gear 36. The number of teeth of the second gear 36 is greater than the number of teeth of the first gear 35. The protective plate 33 is connected to the top seat 11 and the bottom seat 12, and is located at the outer side the first roller 31 and the second roller 32. The protective plate 33 is arranged in parallel with the first roller 31 and the second roller 32. The protective plate 33 has a first limiting portion 37 and a second limiting portion 38 at both ends along its long axis. The first limiting portion 37 has a pin 371 and a plurality of insertion pieces 372 to be secured to the receiving hole 181 and the slots 182 of the first retaining portion 18. The second limiting portion 38 has a pin 381 and a plurality of insertion pieces 382 to be secured to the receiving hole 191 and the slots 192 of the second retaining portion 19. One side of the protective plate 33, close to the second roller 32, has a notch 331 corresponding to the first recessed portion 313 of the first roller 31 and the second recessed portion 321 of the second roller 32. The inner side of the protective plate 33 has a first curved surface 332 and a second curved surface 333. The first curved surface 332 and the second curved surface 333 include a plurality of curved ribs 334 parallel to each other. A first opening 335 is formed between the first curved surface 332 and the first roller 31 to define a first distance L1. A second opening 336 is formed between the second curved surface 333 and the second roller 32 to define a second distance L2. The first distance L1 of the first opening 335 is less than the second distance L2 of the second opening 336. A stopper 337 is provided between the first curved surface 332 of the protective plate 33 and the first roller 31. The stopper 337 may be an elastic member, such as felt.

The power unit 40 is electrically connected to the power drive unit 34. The power unit 40 includes a power storage member 41. The power storage member 41 is electrically connected to the control unit 13. In this embodiment of the present invention, the power storage member 41 is a battery. The power storage member 41 is disposed in the tube 17. In other embodiments, the power storage member 41 is a plurality of batteries that can be taken out of the tube 17.

Figure 5:
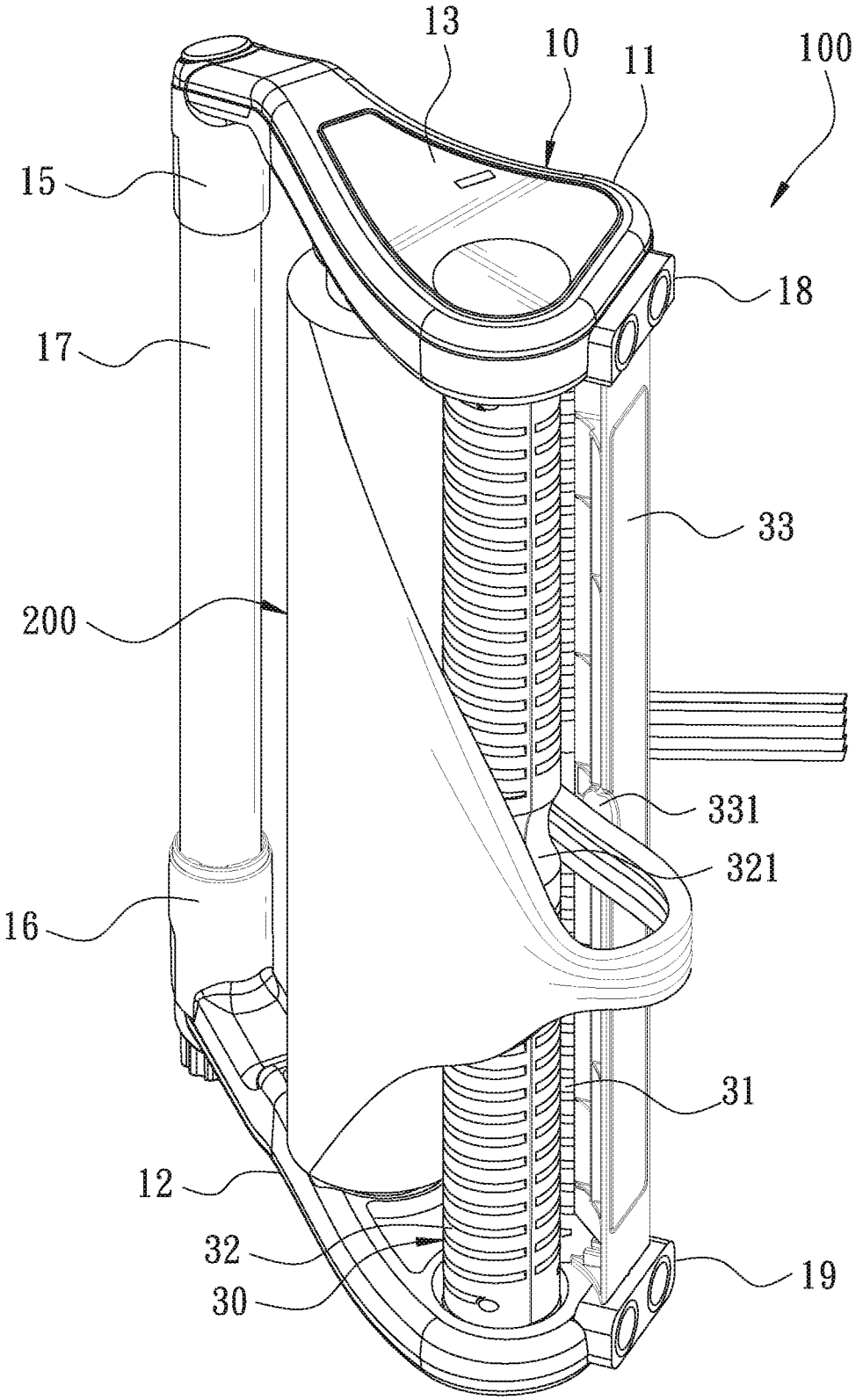
FIG. 5 is a first schematic view according to the preferred embodiment of the present invention when in use.
Figure 6:
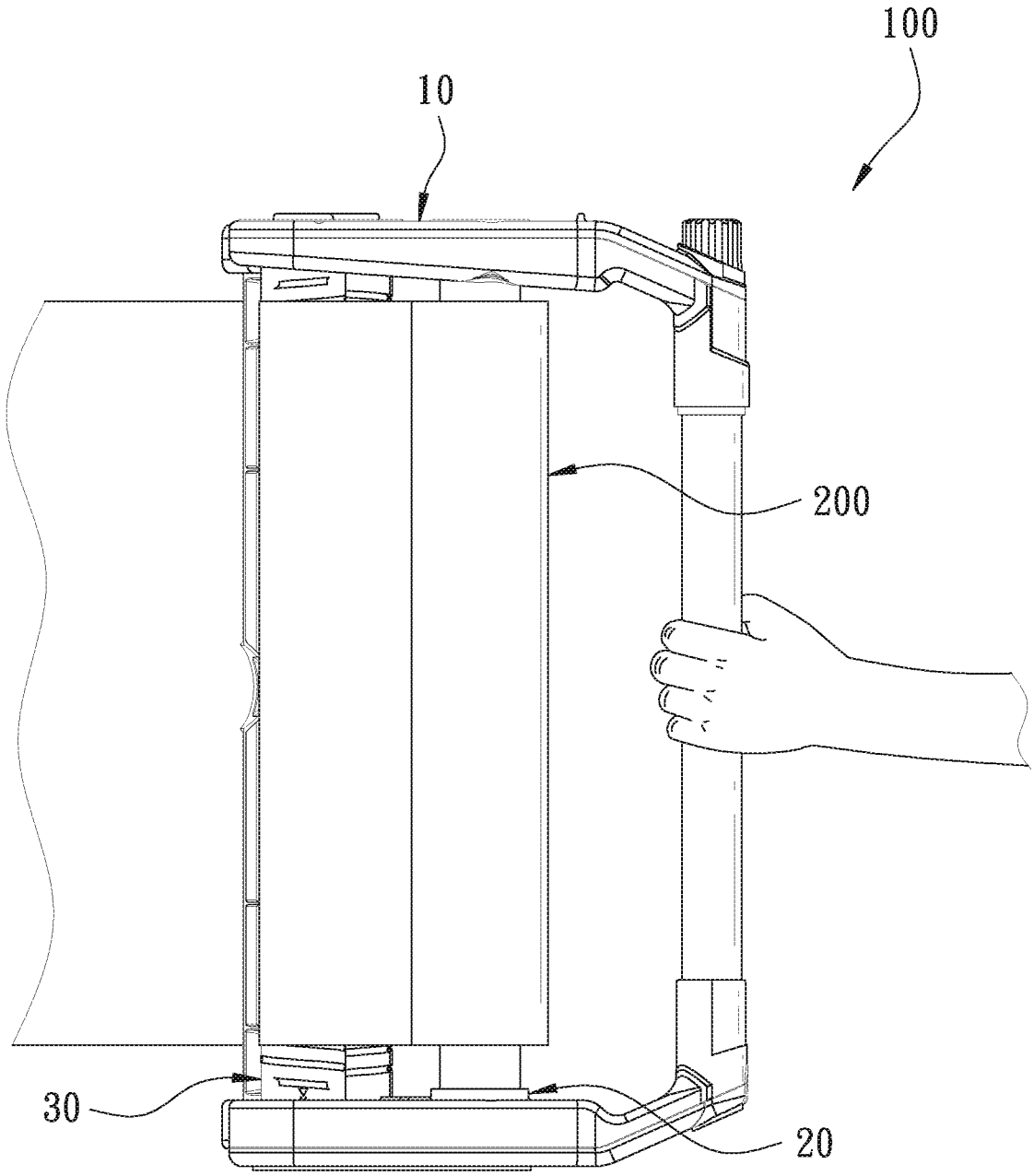
FIG. 6 is a second schematic view according to the preferred embodiment of the present invention when in use.

FIG. 5 and FIG. 6 are schematic views according to the preferred embodiment of the present invention when in use. When the stretch film dispenser 100 of the present invention is to be installed, one end of the film roll 200 is first put into the first accommodating hole 111 and pressed against the first positioning member 21 to compress the elastic member 23. The other end of the film roll 200 is easily put into the second accommodating hole 123 through the guide groove 124 of the second accommodating hole 123, and is pressed against the second positioning member 22 through the elastic member 23 to complete the assembly of the film roll 200. When in use, the front end of the film is first pulled out and curled into a strip, and then the front end of the film is inserted from the second opening 336 of the protective plate 33 into the notch 331 and the strip hole 322 of the first recessed portion 313 and the second recessed portion 321 to complete the installation of the film.

When the stretch film dispenser 100 is to be used, the control unit 13 is first turned on. When the first roller 31 is pulled by the film, the reaction force of the first roller 31 is transmitted to the sensor 14 through the extension member 311, so that the sensor 14 corresponds to the strain and outputs a resistance value to the control unit 13, thereby starting the power drive unit 34 to rotate. Since the power drive unit 34 and the gear box 341 are connected to the retaining member 121, the power drive unit 34 links the gear box 341 and the first linking member 314 to rotate the first roller 31. At the same time, the first linking member 314 drives the first gear 35 to rotate. The first gear 35 drives the second gear 36 to link the second linking member 323 to drive the second roller 32 to rotate. Since the number of teeth of the second gear 36 is greater than that of the first gear 35, the rotational speed of the first roller 31 and the rotational speed of the second roller 32 are different. When the film of the film roll 200 passes between the first roller 31 and the second roller 32, the film is pulled due to the difference in the rotational speed, thereby generating tension. The reaction force of the first roller 31 pulled by the film is transmitted to the sensor 14 through the extension member 311, so that the sensor 14 corresponds to the strain and outputs the resistance value to the control unit 13. The control unit 13 can control the rotational speed and torque of the power drive unit 34, and then automatically generate the required tension, so as to facilitate the application and increase the tension of the film.

It is worth mentioning that the protective plate 33 can prevent the user's hands or foreign objects from being caught between the first roller 31 and the second roller 32. The second opening 336 facilitates the user to insert the film. The stopper 337 located in the first opening 335 is configured to prevent the film from being rolled back to be between the first roller 31 and the second roller 32. It is worth mentioning that the protective plate 33 of the present invention may be applied to manual or electric stretch film dispensers, not limited to electric stretch film dispensers.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stretch film dispenser, comprising:

a frame, having a top seat and a bottom seat, the top seat and the bottom seat being jointly equipped with a film mounting unit and a film dispensing unit, the film dispensing unit including a first roller and a second roller, the first roller has a first recessed portion, the second roller has a second recessed portion corresponding to the first recessed portion of the first roller, the first recessed portion and the second recessed portion jointly form a strip hole, the strip hole being located between the first roller and the second roller.

2. The stretch film dispenser as claimed in claim 1, wherein each of the first recessed portion and the second recessed portion is an arc-shaped ring groove, the first recessed portion is located at a middle position of the first roller, and the second recessed portion is located at a middle position of the second roller.

3. The stretch film dispenser as claimed in claim 1, wherein the film dispensing unit further includes a protective plate, and the protective plate has a notch corresponding to the strip hole.

4. The stretch film dispenser as claimed in claim 3, wherein the protective plate has a stopper, and the stopper is located between the protective plate and the first roller.

5. The stretch film dispenser as claimed in claim 3, wherein an inner side of the protective plate has a first curved surface and a second curved surface, a first opening is formed between the first curved surface and the first roller to define a first distance, a second opening is formed between the second curved surface and the second roller to define a second distance, and the first distance of the first opening is less than the second distance of the second opening.

6. The stretch film dispenser as claimed in claim 5, wherein the first curved surface and the second curved surface include a plurality of curved ribs parallel to each other.

7. The stretch film dispenser as claimed in claim 3, wherein the top seat has a first retaining portion, the bottom seat has a second retaining portion, the protective plate is arranged in parallel with the first roller and the second roller, the protective plate has a first limiting portion and a second limiting portion at two ends thereof, the first limiting portion is secured to the first retaining portion, and the second limiting portion is secured to the second retaining portion.

8. The stretch film dispenser as claimed in claim 1, wherein the frame is provided with a control unit, the control unit includes a sensor, the sensor has a through hole, an extension member is connected to one end of the first roller, the extension member is provided with an extension ring, and the extension ring is accommodated in the through hole of the sensor.

9. The stretch film dispenser as claimed in claim 1, wherein the top seat is formed with a first accommodating hole, the bottom seat is formed with a second accommodating hole, a guide groove is provided on an outer periphery of the second accommodating hole, the film mounting unit includes a first positioning member and a second positioning member, the first positioning member is disposed in the first accommodating hole, the first positioning member is connected to an elastic member, two ends of the elastic member are pressed against the first accommodating hole and the first positioning member respectively, and the second positioning member is disposed in the second accommodating hole.

* * * * *